US008661861B2

(12) United States Patent
Lai

(10) Patent No.: US 8,661,861 B2
(45) Date of Patent: Mar. 4, 2014

(54) DUAL LOCKING SYSTEM FOR INTEGRATED ZIPPER LOCK

(75) Inventor: Karl Lai, Hong Kong (HK)

(73) Assignee: The Sun Lock Company Ltd., Tuen Mun, NT (HK)

( * ) Notice: Subject to any disclaimer, the term of this patent is extended or adjusted under 35 U.S.C. 154(b) by 0 days.

(21) Appl. No.: 13/554,299

(22) Filed: Jul. 20, 2012

(65) Prior Publication Data

US 2013/0036778 A1 Feb. 14, 2013

Related U.S. Application Data

(60) Provisional application No. 61/574,764, filed on Aug. 8, 2011.

(51) Int. Cl.
*E05B 37/14* (2006.01)

(52) U.S. Cl.
USPC ..... 70/21; 70/68; 70/71; 70/284; 70/285

(58) Field of Classification Search
USPC ..... 70/21, 68–72, 74, 284, 285, DIG. 63, 70/DIG. 71
See application file for complete search history.

(56) References Cited

U.S. PATENT DOCUMENTS

| | | | | |
|---|---|---|---|---|
| 5,485,734 | A * | 1/1996 | Yang | 70/285 |
| 6,408,660 | B1 | 6/2002 | Lai | |
| 6,513,356 | B1 * | 2/2003 | Yang | 70/213 |
| 6,912,880 | B2 * | 7/2005 | Ling et al. | 70/71 |
| 7,415,853 | B2 * | 8/2008 | Yu | 70/68 |
| 7,562,545 | B2 * | 7/2009 | Lai et al. | 70/21 |
| 8,096,150 | B2 * | 1/2012 | Lai et al. | 70/21 |
| 8,113,024 | B2 * | 2/2012 | Yang | 70/284 |
| 8,161,778 | B1 * | 4/2012 | Ma | 70/21 |
| 2005/0072196 | A1 * | 4/2005 | Ling et al. | 70/284 |
| 2008/0087049 | A1 * | 4/2008 | Lai et al. | 70/25 |
| 2008/0236212 | A1 * | 10/2008 | Ma | 70/77 |

* cited by examiner

*Primary Examiner* — Christopher Boswell
(74) *Attorney, Agent, or Firm* — Ware, Fressola, Maguire & Barber LLP

(57) ABSTRACT

The present invention is directed to a zipper lock that includes an actuator operatively connected to an actuation plate and a blocking plate positioned relative to the actuation plate so as to at least partially block the movement of the actuation plate when the zipper lock is in the locked configuration. The actuator and the actuation plate are configured for interaction so as to transform movement of the actuator into movement of the actuation plate when the zipper lock is in an unlocked configuration. The zipper lock further includes a latch control plate operatively connected to the actuator, and operatively connected to a latch, in which the latch includes a locking finger configured for locking engagement with at least one locking head that is configured to retain a zipper pull tab to the zipper lock when the zipper lock is in a locked configuration.

20 Claims, 8 Drawing Sheets

DUAL LOCKING SYSTEM FOR INTEGRATED ZIPPER LOCK

CROSS-REFERENCE TO RELATED APPLICATIONS

This application claims priority to U.S. Provisional Appl. No. 61/574,764 filed Aug. 8, 2011, which is hereby incorporated by reference in its entirely.

BACKGROUND OF THE INVENTION

1. Field of the Invention

This invention relates to locks, and more particularly, to a zipper lock with a dual locking system.

2. Description of Related Art

Numerous padlock constructions have been developed and are widely employed by individuals to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence. However, these combination lock constructions suffer from common deficiencies which have not been successfully overcome.

Most constructions of combination padlocks incorporate a J-shaped or U-shaped shackle which is employed to provide the desired engagement with the suitcase or items to be locked. In one of the most popular applications, the shackle is inserted through apertures formed in the zipper pulls which are mounted to the suitcase in order to maintain the suitcase in the secured and locked position. Although most suitcases, or similar products, which incorporate zippers for maintaining cooperating portions thereof in the closed position are locked by the owner using padlocks incorporating J-shaped or U-shaped shackles, one group of products which has recently become popular are lock constructions designed for independently receiving and securing the two separate and independent zipper pulls mounted to a suitcase, or similar product. In this way, a suitcase or similar product can be securely locked using a lock construction which is more easily integrated into the body of the suitcase, as opposed to being a separate and independent element which hangs from the product.

Although the combination padlocks constructed for receiving and securing zipper pulls directly therein incorporate a construction which is readily distinguishable from padlocks incorporating conventional shackles, the problems associated with rotatable dial/shackle padlocks is typically identical to the problems associated with rotatable dial/zipper pull padlocks. As a result, many manufacturers have attempted to solve the problems associated with rotatable dial or combination locks.

One principal difficulty and drawback found in these constructions which has not been overcome is a construction which assures the user that a preset combination will not be accidentally or inadvertently altered or changed, without the user's knowledge. In such instances when the known combination is unknowingly changed or altered without the user's knowledge, the entire combination lock is incapable of future use, since the user is typically unable to release the shackle from locked engagement with the housing.

In addition, although key operated locks do not suffer from the difficulty of having the combination changed or altered without the user's knowledge, users are frequently incapable of using key operated locks, due to the key being lost or misplaced. As a result, key operated locks are also frequently discarded due to the user's inability to find a particular key for operating the lock.

Another common problem which has consistently plagued lock constructions is the cost of construction for producing and assembling padlocks, whether the padlock is key operated or combination operated. In order to attain a padlock which provides all of the features desired by consumers, prior art constructions typically incorporate numerous small components, each of which require expensive assembly procedures to produce the final product. As a result, these lock constructions are expensive to produce, thereby reducing the ability of these locks to reach a broad base of consumers.

Another problem commonly found with padlocks is the inability of these constructions to prevent contaminants from reaching the rotatable, internal component of the lock, thereby causing damage to these components or interfering with the ease of operating the lock by an individual who either knows the actual combination or has the activating key. Although numerous attempts have been made to reduce the adverse effects caused by contaminants reaching these components, such attempts have been incapable of completely eliminating in this problem.

A final, still further difficulty, which has recently arisen and affects both combination locks and key operated locks, is a requirement that all secured locks must be broken by Customs officers, and/or inspection or security personnel in order to gain access to luggage which is deemed suspicious. Under new security regulations that have been implemented, all luggage must be scanned or inspected to prevent the transportation of potentially dangerous items or products which are deemed to be undesirable. In those instances when luggage is scanned and further visual inspection is required, the inspectors have the authority to open the luggage for visual inspection, including physically breaking any lock which may be on the luggage.

Consequently, with these new regulations presently implemented, all lock systems which are incapable of being opened by inspectors and/or security personnel are subject to be physically broken, in order to gain access to any luggage which needs to be visually inspected. As a result, consumers will now be faced with the possibility that any lock system employed to protect the contents of a suitcase can be physically removed by security personnel, leaving the luggage completely unprotected during the remainder of the trip.

Furthermore, additional new regulations have been implemented requiring lock manufacturers who produce key operated locks for use by security personnel must employ constructions which enable the key to be removed when the lock is in the open position. This additional regulation has further complicated the construction of prior art padlocks as well as adding additional difficulties to the typical operation of key operated padlocks.

In addition, some padlocks have been constructed which do provide a dual locking system for enabling security personnel to gain access to the lock, when necessary. However, these prior art dual locking padlock systems are typically limited to only padlocks incorporating J-shaped or U-shaped shackles. Dual locking padlocks constructed for securing zipper pulls to the lock system have not been created and leave such padlocks vulnerable to being broken by security personnel whenever inspection is required of a suitcase employing these locks.

Therefore, it is a principal object of the present invention to provide a padlock system having a fully integrated dual locking construction which is configured for securing the zipper pulls of a suitcase thereto.

Another object of the present invention is to provide a dual locking, zipper pull padlock having the characteristic features described above which is easily produced and provides the user with complete control over resetting the combination employed therein.

Another object of the present invention is to provide a dual locking, zipper pull padlock having the characteristic features described above which is easily produced in a cost effective manner.

Other and more specific objects will in part be obvious and will in part appear hereinafter.

SUMMARY OF THE INVENTION

An exemplary embodiment of the present invention is directed to an integrated zipper lock which is mounted on a zipper case, and the lock is configured to be opened by a combination locking mechanism and/or a key overriding mechanism. The combination locking system is similar to the one described in our U.S. Pat. No. 6,408,660, which is hereby incorporated by reference in its entirety. The key locking system includes a disc tumbler cylinder. The two locking systems are operatively connected to a latch and a latch-control plate which are configured to cause a left locking head and a right locking head to move away from a locking position of the zipper lock in which zipper pull tabs of a zipper are retained by the zipper lock. The integrated zipper lock also includes one or more blocking plates that restricts the left locking head and the right locking head from returning back to the locking position once the zipper lock is caused to be moved to the unlocked position by either the combination locking mechanism or the key locking mechanism until the one or more blocking plates are moved. For example, the left locking head and the right locking head will remain in the open and unlocked position until the zipper pull tabs are pushed into the one or more blocking plates to allow the left locking head and right locking head to return back to the locking position.

In accordance with the exemplary embodiment of the invention, in the locked mode of the zipper lock, the combination is not set to the lock open combination on the combination locking mechanism, and therefore notches on the clutches that are rotably affixed to the combination dials are not aligned with protrusions extending from a locking plate. Therefore, the locking plate cannot move, and a user of the zipper lock cannot push a release actuator because a tail of the blocking plate blocks the movement of a actuation plate operatively connected to the release actuator. Since the actuation plate cannot be moved, the user cannot move the latch-control plate, and therefore cannot move the latch to its release and unlock position. Since the latch is in the locked position, a locking finger of the latch is engaged into a locking area formed by the left locking head and the right locking head. This engagement thereby prevents opening of the zipper lock.

In accordance with the exemplary embodiment of the invention, when the dials are aligned to the open lock combination of the combination locking mechanism, each notch of each clutch will be facing and aligned with the corresponding protrusion of the locking plate. This will allow the locking plate to move leftward since a spring is engaged with the locking plate, and configured to push the locking plate leftward. As the locking plate moves leftward, the user can then push the actuator inward. As the actuator moves in the same direction as the locking plate, e.g. leftward, the slope of the actuator contacts the slope of the actuation plate. These slopes will help to transfer the horizontal movement of the actuator (e.g. the actuator moving leftward) to a vertical movement of the actuation plate (e.g. the actuation plate moving downward). The actuation plate is able to move downward because the tail of the locking plate is no longer blocking the tip of the actuation plate as the locking plate has already been moved leftward. As the user keeps on pushing the actuator further leftward, the tip of the actuator will contact the wall of the latch-control plate. Hence, the latch-control plate will also move leftward.

As the latch-control plate moves leftward, the slope of the latch-control plate will contact the slope of the latch. Again, these slopes will help to transfer the horizontal movement from the latch-control plate to a vertical movement of the latch. As the latch moves upward the locking finger will no longer be in contact with the locking area of the left locking head and right locking head. As the user pushes the actuator more leftward, since the latch has moved upward and the locking finger has been detached from the locking area, the wall of the latch-control plate will be in contact with the ends of the left locking head and the right locking head. Therefore, the left locking head and right locking head will move leftward. As the left locking head and right locking head move leftward, the zipper pull tabs can be released away from the body of the zipper lock.

In accordance with the exemplary embodiment of the invention, the zipper lock may include one or more blocking plates that have two functions for the zipper lock. First, the one or more blocking plates may help the zipper pull tabs to pop up and out of the body of the zipper lock when the left and right locking heads move leftward. Since a blocking plate spring pushes each of the one or more blocking plates upward, the zipper pull tabs can pop away from the body when the left and right locking heads moves leftward. The second function of the one or more blocking plate is that each blocking plate does not allow the left and right locking heads to move back to the locking position once it is being opened by either of the combination locking mechanism or the key locking mechanism. As the left and right locking heads move leftward, the blocking plates move upward. As the blocking plates move upward, a wall of the blocking plates will contact a plane of each of the left locking head and right locking head. Therefore, the wall of each of the blocking plates act to restrict the left and right locking heads from moving back to the locking position. The left and right locking heads can move back to the locking position when the zipper pull tabs are inserted and depress the blocking plates downward. The walls of the blocking plates will no longer contact to the planes of the left and right locking heads. Therefore, the left and right locking heads springs will force the locking latches to move back to the locking position.

When the dials are aligned to the open lock combination, the notches of each of the clutches will be facing with corresponding protrusions of the locking plate. This will allow the locking plate to move leftward since the spring is pushing the locking plate leftward. As the locking plate moves leftward, the tail of the locking plate moves leftward respectively. Once the tail of the locking plate moves leftward, the user can push the actuator leftward. As the actuator is pushed leftward, the actuation plate will move downward as already discussed above. As the actuation plate moves downward, the tip moves downward and will block the tail of the locking plate back to the original position (rightward). The locking plate cannot move when the tip moves downward. The notches are engaged with the protrusion. The locking plate is not able to move rightward, therefore, the user can push and hold the actuator and turn the dials for setting their own desired combination.

In accordance with the exemplary embodiment of the invention, the key locking mechanism is configured to operate in the following manner. On turning a key configured to actuate the key locking mechanism, the cylinder turns and the turning movement is transferred to a cam. As the cam turns, a finger extending from the cam contacts an arm of the latch-control plate which causes the latch-control plate to move leftward. The system will go through the unlock process in the same manner as described in the above with respect to the combination locking mechanism. The key can be withdrawn from the cylinder once the zipper pull tabs have been released from the zipper lock.

In accordance with an exemplary embodiment of the present invention, a zipper lock according to the present invention includes a actuator operatively connected to a actuation plate and a blocking plate positioned relative to the actuation plate so as to at least partially block the movement of the actuation plate when the zipper lock is in the locked configuration, in which a sloped surface on the actuator and a sloped surface on the actuation plate are configured for interaction so as to transform horizontal movement of the actuator relative to the actuation plate into vertical movement of the actuation plate relative to the actuator when the zipper lock is in an unlocked configuration. The zipper lock further includes a latch-control plate operatively connected to the actuator, and operatively connected to a latch, in which the latch includes a locking finger configured for locking engagement with left and right locking heads that are each configured to retain a zipper pull tab to the zipper lock when the zipper lock is in a locked configuration.

In the exemplary zipper lock according to the present invention, the latch-control plate includes a sloped surface that is configured to interact with a sloped surface of the latch in order to transform horizontal movement of the latch-control plate relative to the latch into vertical movement of the latch relative to the latch-control plate. This relative vertical movement of the latch causes the locking finger to detach away from a locking area formed from the left and right locking heads.

In accordance with the exemplary embodiment of the present invention, the zipper lock further includes one or more blocking plates that are configured to push the zipper pull tabs out of the body of the zipper lock when the left and right locking heads are released from the locked position. A wall of each of the blocking plates restricts the left and right locking heads from returning to the locking position. This system of blocking the zipper locking heads by using a blocking plate or any form of blocking element after unlock allows the lock to remain in the unlock mode after key is withdrawn from the cylinder and hence has fulfilled a non-key captive requirement.

Another exemplary embodiment of the present invention is directed to a lock that includes a latch movable between a first position and a second position, a first locking mechanism operatively coupled to the latch, a second locking mechanism operatively coupled to the latch, and at least one locking head operatively coupled to the first locking mechanism and the second locking mechanism, and positionable between a closed position and an open position.

In accordance with the exemplary embodiment of the present invention, the first locking mechanism and/or the second locking mechanism is configured to move the latch into the second position, and the at least one locking head is configured for positioning in the open position when the latch is in the second position.

In accordance with the exemplary embodiment of the present invention, the latch may include a substantially cylindrical extension, the at least one locking head may include a locking area configured to operatively engage the cylindrical extension when the latch is in the first position and the at least one locking head is in the closed position, and the lock further may also include a latch spring operatively coupled to the latch and configured to urge the latch into the first position, and a locking head spring for each locking head of the at least one locking head configured to urge the at least one locking head into the closed position.

In accordance with the exemplary embodiment of the present invention, the lock may also include at least one blocking plate operatively coupled to each of the at least one locking head, the at least one blocking plate is movable in a direction substantially perpendicular to the movement of the at least one locking head between a retained position and an ejected position, and the lock may also include a blocking plate spring for each of the at least one blocking plate configured to urge the at least one blocking plate into the ejected position.

In accordance with the exemplary embodiment of the present invention, the at least one blocking plate may include a wall formed on an edge of the at least one blocking plate, and the wall is configured to hold the at least one locking head in the open position when the at least one blocking plate is in the ejected position.

In accordance with the exemplary embodiment of the present invention, the lock is configured to securely retain at least one zipper pull tab of a zipper, and the at least one zipper pull tab comprises an opening formed therein.

In accordance with the exemplary embodiment of the present invention, the at least one locking head includes a locking protrusion extending therefrom, and dimensioned for insertion into the opening of the at least one zipper pull tab, and the at least one blocking plate includes a retaining wall extending therefrom, and positioned on the at least one blocking plate for operative engagement with the locking protrusion when the at least one locking head is in the closed position in order to securely retain the at least one zipper pull tab to the lock.

In accordance with the exemplary embodiment of the present invention, the first locking mechanism includes a lock cylinder, a locking cam operatively coupled to the lock cylinder, and a finger extending from the locking cam, and the lock further may also include a control plate operatively coupled to the finger and to the latch, and movable in a direction substantially perpendicular to the movement of the latch.

In accordance with the exemplary embodiment of the present invention, the control plate is configured to transfer angular movement of the finger to rectilinear movement of the at least one locking head in order to move the at least one locking head into the open position.

In accordance with the exemplary embodiment of the present invention, the first locking mechanism is operative between a locked position and an unlocked position.

In accordance with the exemplary embodiment of the present invention, when the first locking mechanism is in the locked position the finger is spaced away from the control plate, and when the first locking mechanism is in the unlocked position the finger is configured for positioning in operative engagement with the control plate.

In accordance with the exemplary embodiment of the present invention, when the first locking mechanism is in the unlocked position the latch is movable to the second position and the at least one locking head is positionable in the open position.

In accordance with the exemplary embodiment of the present invention, in the unlocked position of the first locking mechanism, the finger is configured to operatively engage with the control plate to cause rectilinear movement of the control plate towards the latch, and the rectilinear movement of the control plate is configured to move the latch in a direction substantially perpendicular to the rectilinear movement of the control plate in order to move the latch into the second position and thereby disengage the cylindrical extension of the latch from the locking area of the at least one locking head.

In accordance with the exemplary embodiment of the present invention, in the unlocked position of the first locking mechanism the finger is further configured to operatively engage with the control plate to cause further rectilinear movement of the control plate towards the at least one locking head, and the further rectilinear movement of the control plate is configured to move the at least one locking head into the open position.

In accordance with the exemplary embodiment of the present invention, the first locking mechanism is configured for operation between the locked position and the unlocked position through the use of a tool.

In accordance with the exemplary embodiment of the present invention, the tool may include a key.

In accordance with the exemplary embodiment of the present invention, the second locking mechanism may include an actuator, a locking plate operatively coupled to the actuator, and at least one rotatable clutch configured to restrict movement of the locking plate.

In accordance with the exemplary embodiment of the present invention, the lock may also include a control plate operatively coupled to the actuator and to the latch, and movable in a direction substantially perpendicular to the movement of the latch.

In accordance with the exemplary embodiment of the present invention, the locking plate is movable between a locked position and an unlocked position, and the second locking mechanism may also include a locking plate spring configured to urge the locking plate into the unlocked position.

In accordance with the exemplary embodiment of the present invention, the locking plate may include at least one opening formed therein, and each opening of the at least one opening may include a protrusion extending into the opening.

In accordance with the exemplary embodiment of the present invention, each opening of the at least one opening has one of the at least one rotatable clutch positioned therein, each rotatable clutch of the at least one rotatable clutch includes a notch formed therein and configured to receive the protrusion, when the notch and the protrusion are substantially aligned the locking plate spring is configured to urge the locking plate into the unlocked position, and when the notch and the protrusion are not substantially aligned the at least one rotatable clutch is configured hold the locking plate in the locked position.

In accordance with the exemplary embodiment of the present invention, the second locking mechanism may also include an actuation plate operatively coupled to the actuator and movable between a blocking position and an actuated position, and an actuation plate spring configured to urge the actuation plate into the blocking position.

In accordance with the exemplary embodiment of the present invention, the locking plate may also include a tail extending therefrom and configured to operatively engage with the actuation plate when the locking plate is in the locked position and have a spaced apart relationship with the actuation plate when the locking plate is in the unlocked position, and the tail is configured to substantially retain the actuation plate in the blocking position when the tail is operatively engaged with the actuation plate.

In accordance with the exemplary embodiment of the present invention, in the unlocked position of the locking plate the actuator is configured move the actuation plate into the actuated position and to operatively engage with the control plate to cause rectilinear movement of the control plate towards the latch, and the rectilinear movement of the control plate is configured to move the latch in a direction substantially perpendicular to the rectilinear movement of the control plate in order to move the latch into the second position and thereby disengage the cylindrical extension of the latch from the locking area of the at least one locking head.

In accordance with the exemplary embodiment of the present invention, in the unlocked position of the locking plate the actuator is further configured to operatively engage with the control plate to cause further rectilinear movement of the control plate towards the at least one locking head, and the further rectilinear movement of the control plate is configured to move the at least one locking head into the open position.

In accordance with the exemplary embodiment of the present invention, each of the at least one rotatable clutch is operatively connected to a dial comprising a substantially circular surface having indicia thereon.

In accordance with the exemplary embodiment of the present invention, the actuator may include a button.

BRIEF DESCRIPTION OF THE SEVERAL VIEWS OF THE DRAWINGS

For a fuller understanding of the nature and object of the present invention, reference should be had to the following detailed description taken in connection with the accompanying drawings, in which.

DETAILED DESCRIPTION OF THE INVENTION

Figure 1A:
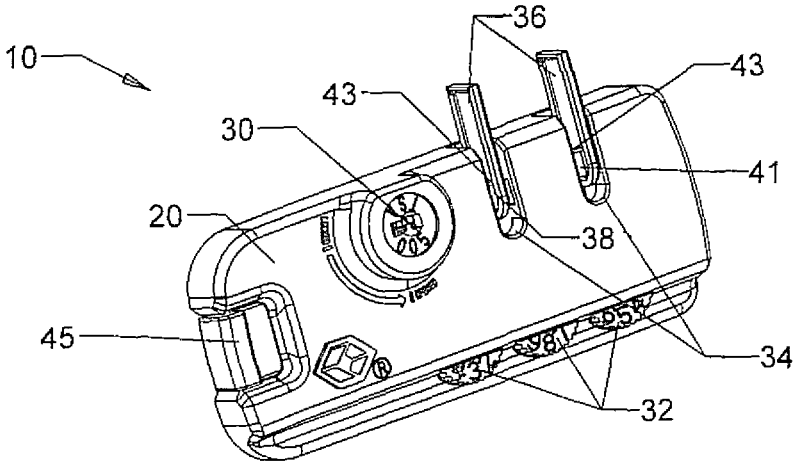
FIG. 1A is a perspective view of an exemplary zipper lock in accordance with the present invention.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Figure 1B:
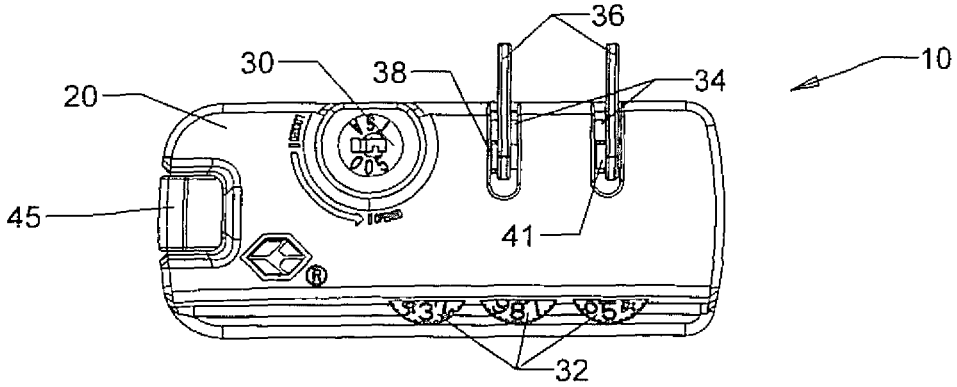
FIG. 1B is a top plan view of the exemplary zipper lock in accordance with the present invention.
Figure 1C:
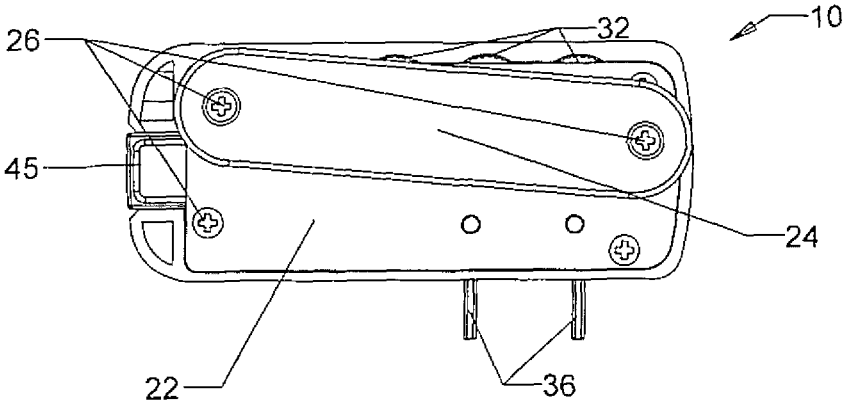
FIG. 1C is a bottom plan view of the exemplary zipper lock in accordance with the present invention.
Figure 2A:
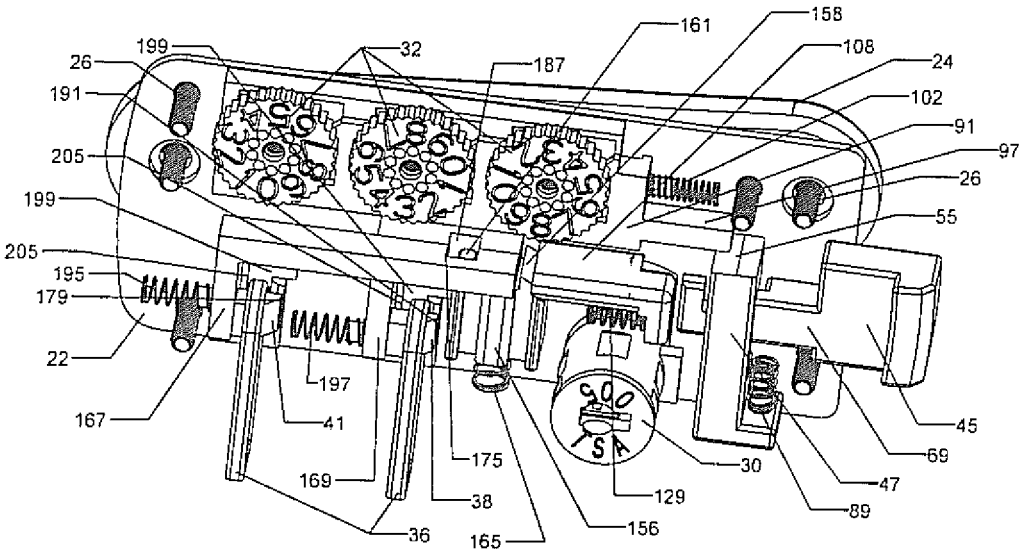
FIG. 2A is a perspective view of the exemplary zipper lock with a cover portion of the lock removed in accordance with the present invention.
Figure 2B:
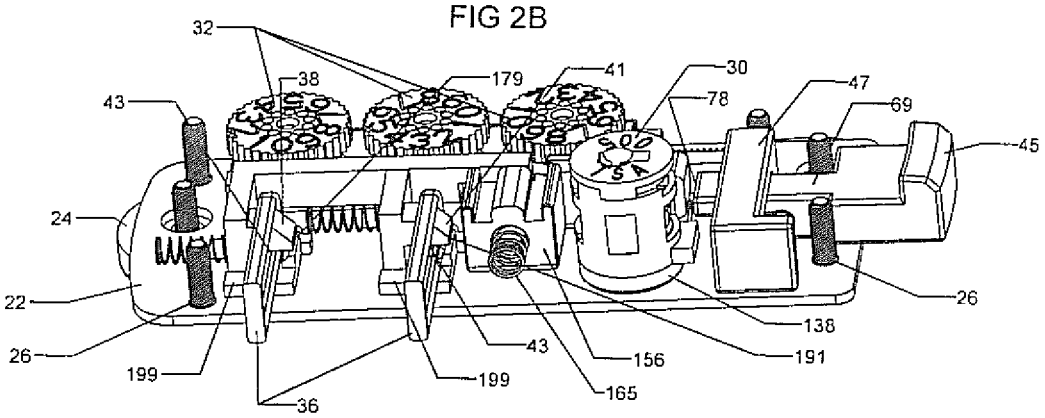
FIG. 2B is a perspective view of the exemplary zipper lock with the cover portion of the lock removed in accordance with the present invention.
Figure 2C:
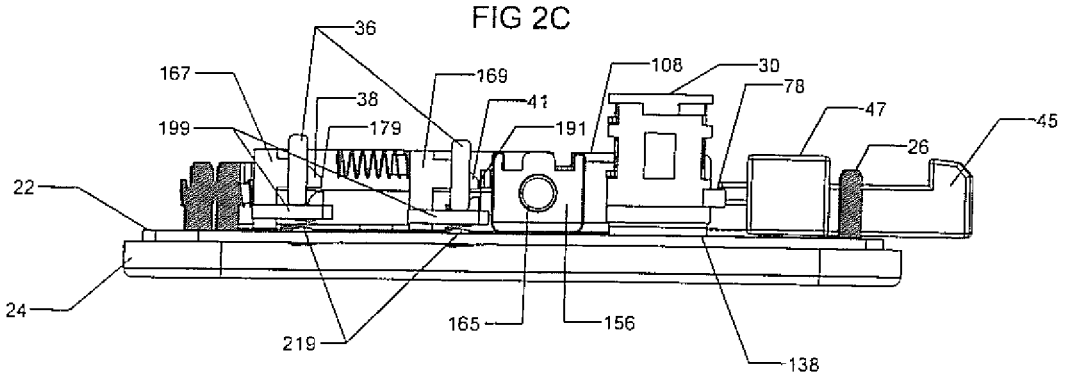
FIG. 2C is a side view of the exemplary zipper lock with the cover portion of the lock removed in accordance with the present invention.

Referring first to FIGS. 1A-1C, therein illustrated is an exemplary zipper lock generally indicated by the numeral 10 of the present invention. The zipper lock 10 includes a body 20 and a backing plate 22 that together form a housing/cover for the internal components of the zipper lock 10 that will be discussed further below. The zipper lock 10 also includes a back cover 24 that also forms part of the housing/cover for the internal components of the zipper lock 10. The backing plate 22, back cover 24 and body 20 may be affixed together by one or more fasteners 26, and the fasteners 26 may be such that they cannot be removed once tightened or only removed through the use of a specially designed tool. The zipper lock 10 also includes a key locking mechanism that includes a disc tumbler cylinder 30 and a combination locking mechanism that includes one or more dials 32 that are configured to allow a predetermined combination to be set on the combination locking mechanism. The zipper lock 10 also includes a pair of cavities 34 defined in the body 20 that are each dimensioned to receive a zipper pull tab 36 of a zipper (not shown). The zipper may include two zipper pull tabs 36 so that when each zipper pull tab 36 is retained in the zipper lock 10, the zipper cannot be opened. The zipper lock 10 may retain each of the zipper pull tabs 36 within the pair of cavities 34 by extending a locking protrusion 38, 41 through a hole 43 in each of the zipper pull tabs 36. The locking protrusions 38, 41 engage with the holes 43 of the zipper pull tabs 36, and prevent the zipper pull tabs 36 from being removed from the cavities 34 of the zipper lock 10. The zipper lock 10 also includes a actuator 45 that is operatively connected to the locking protrusions 38, 41, and configured for actuation in order to release the locking protrusions 38, 41 from the zipper pull tabs 36 when the combination locking mechanism is unlocked, as will be discussed further below.

Figure 6:
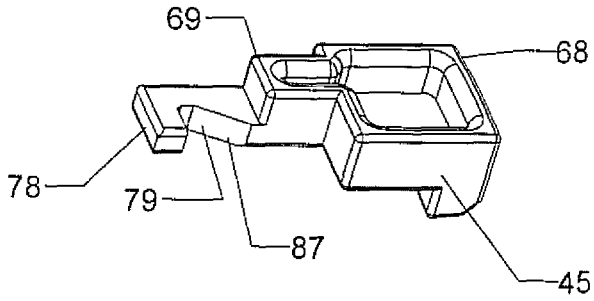
FIG. 6 is a perspective view of an exemplary actuator of the exemplary zipper lock in accordance with the present invention.
Figure 7:
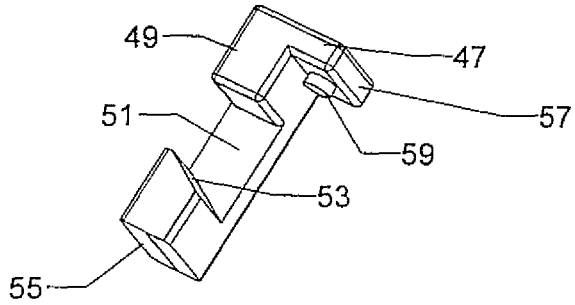
FIG. 7 is a perspective view of an exemplary actuator controlled plate of the exemplary zipper lock in accordance with the present invention.

Referring now to FIGS. 2A-2C and 3-5, the zipper lock 10 also includes a actuation plate 47 operatively connected to the actuator 45. As shown in detail in FIG. 7, the actuation plate 47 includes a columnar body 49 with a notch 51 formed therein. The actuation plate 47 also includes a slope 53 that forms one of the surfaces defining the notch 51. The actuation plate 47 also includes a tip 55 at one end of the columnar body 49, and a shoulder 57 extending from the opposite end of the columnar body 49. A cylindrical extension 59 extends from a surface of the shoulder 57 of the actuation plate 47. As shown in detail in FIG. 6, the actuator 45 includes a head portion 68 and an arm portion 69 extending from the head portion 68. The arm portion 69 includes a tip 78 at one end of the arm portion 69, and a notch 79 positioned between the tip 78 and the head portion 68 of the actuator 45. The arm portion 69 includes a slope 87 that defines a surface of the notch 79. Referring again to FIGS. 2A-2C and 3-5, it is shown that the arm portion 69 of the actuator 45 extends through the notch 51 of the button controlled plate, and that the slope 87 of the actuator 45 is positioned for operative engagement with the slope 53 of the actuation plate 47. The cylindrical extension 59 of the actuation plate 47 is positioned to engage an actuation plate spring 89 so that the actuation plate 47 is urged in a direction perpendicular to the actuator 45 so that the slope 87 of the actuator 45 will be in contact with the slope 53 of the actuation plate 47. Positioned in a blocking arrangement with the tip 55 of the actuation plate 47 is a locking plate 91.

Figure 14:
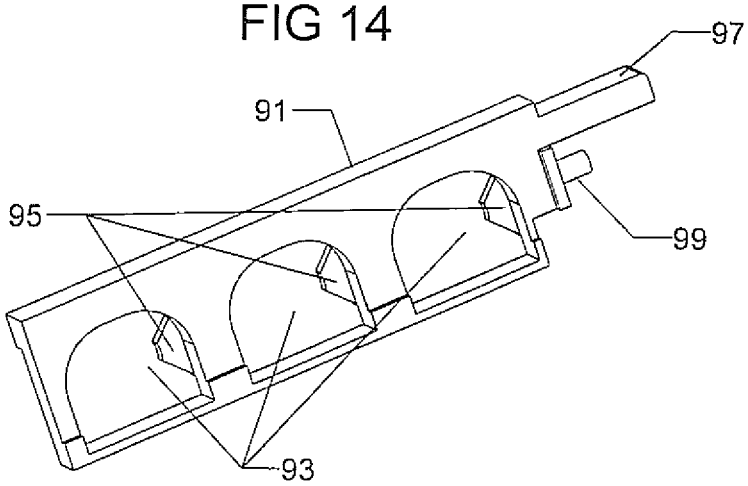
FIG. 14 is a perspective view of an exemplary locking plate of the exemplary zipper lock in accordance with the present invention.

As shown in detail in FIG. 14, the locking plate 91 includes one or more openings 93 and a protrusion 95 extending into each of the one or more openings 93. The locking plate 91 also includes a tail 97 extending from one end thereof, and a cylindrical extension 99 that is configured to engage with a locking plate spring 102. The locking plate spring 102 is positioned and configured to urge the locking plate 91 in a direction substantially perpendicular to the actuation plate 47, and away from the actuator 45. As shown in particular in FIG. 3, the tail 97 of the locking plate 91 is positioned so as to prevent movement of the actuation plate 47 when the correct combination has not been set on the dials 32 of the combination locking mechanism.

Referring again to FIGS. 3-5, each of the dials 32 has a clutch 104 attached thereto, and connected to the each of the dials 32 so that rotational movement of the dials 32 is transferred to each of the clutches 104. The clutches 104 are positioned within the one or more openings 93 of the locking plate 91. Each of the clutches 104 includes a notch 106 that is dimensioned to receive the protrusions 95 extending from the locking plate 91 when all of the one or more dials 32 have been set to the correct combination of the combination locking mechanism. The protrusions 95 are urged into the notches 106 by the locking plate spring 102 acting upon the locking plate 91.

Figure 8A:
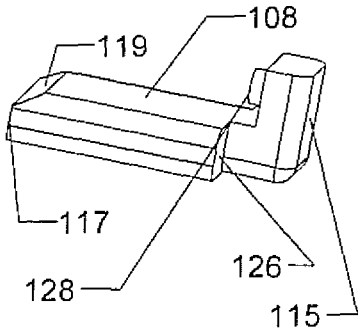
FIG. 8A is a side perspective view of an exemplary latch-control plate of the exemplary zipper lock in accordance with the present invention.
Figure 8B:
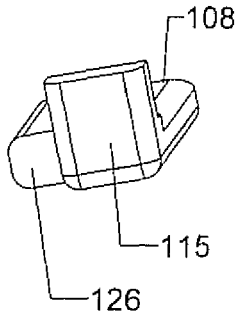
FIG. 8B is a top perspective view of the exemplary latch-control plate of the exemplary zipper lock in accordance with the present invention.
Figure 8C:
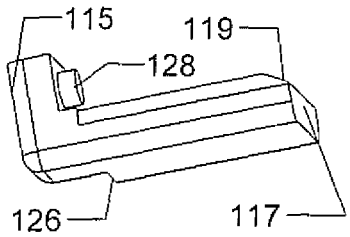
FIG. 8C is a side perspective view of the exemplary latch-control plate of the exemplary zipper lock in accordance with the present invention.

Referring again to FIGS. 2A-2C and 3-5, the zipper lock 10 also includes a latch control plate 108 positioned adjacent to the tip 78 of the actuator 45. As shown in detail in FIGS. 8A, 8B and 8C, the latch control plate 108 includes a wall 115 at one end of the latch control plate 108, and an end wall 117 positioned on the opposite end of the latch control plate 108. The latch control plate 108 also includes a slope 119 positioned adjacent to the end wall 117, and an arm 126 extending from a side of the latch control plate 108. The latch control plate 108 further includes a cylindrical extension 128 extending from a surface of the latch control plate 108 positioned opposite the wall 115. Referring again to FIGS. 2A and 3-5, the cylindrical extension 128 is configured for engagement with a spring 129 that urges the latch control plate 108 towards the tip 78 of the actuator 45.

Figure 3:
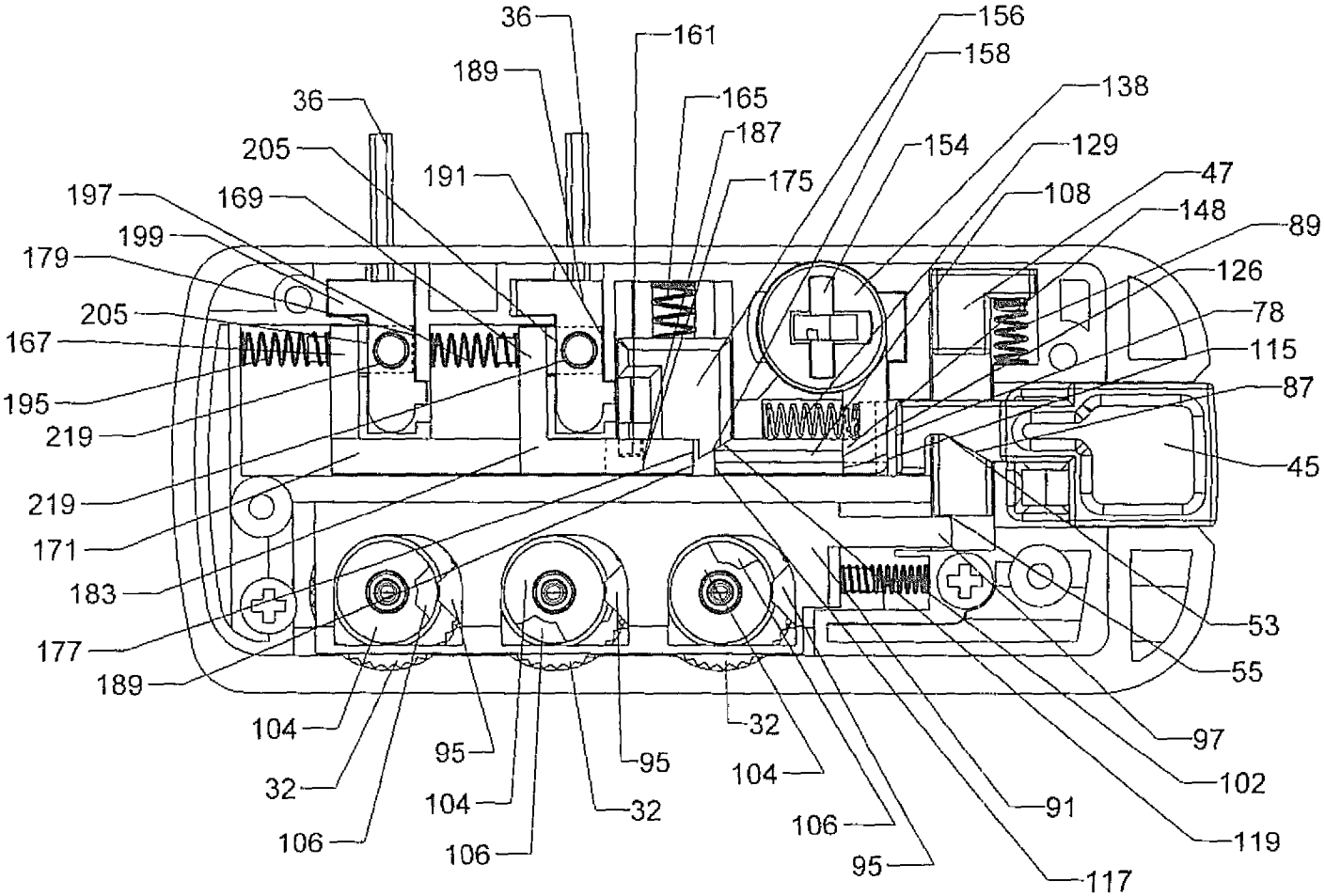
FIG. 3 is a bottom plan view of the exemplary zipper lock with the cover portion of the lock removed, in which the zipper lock is in a locked state.
Figure 4:
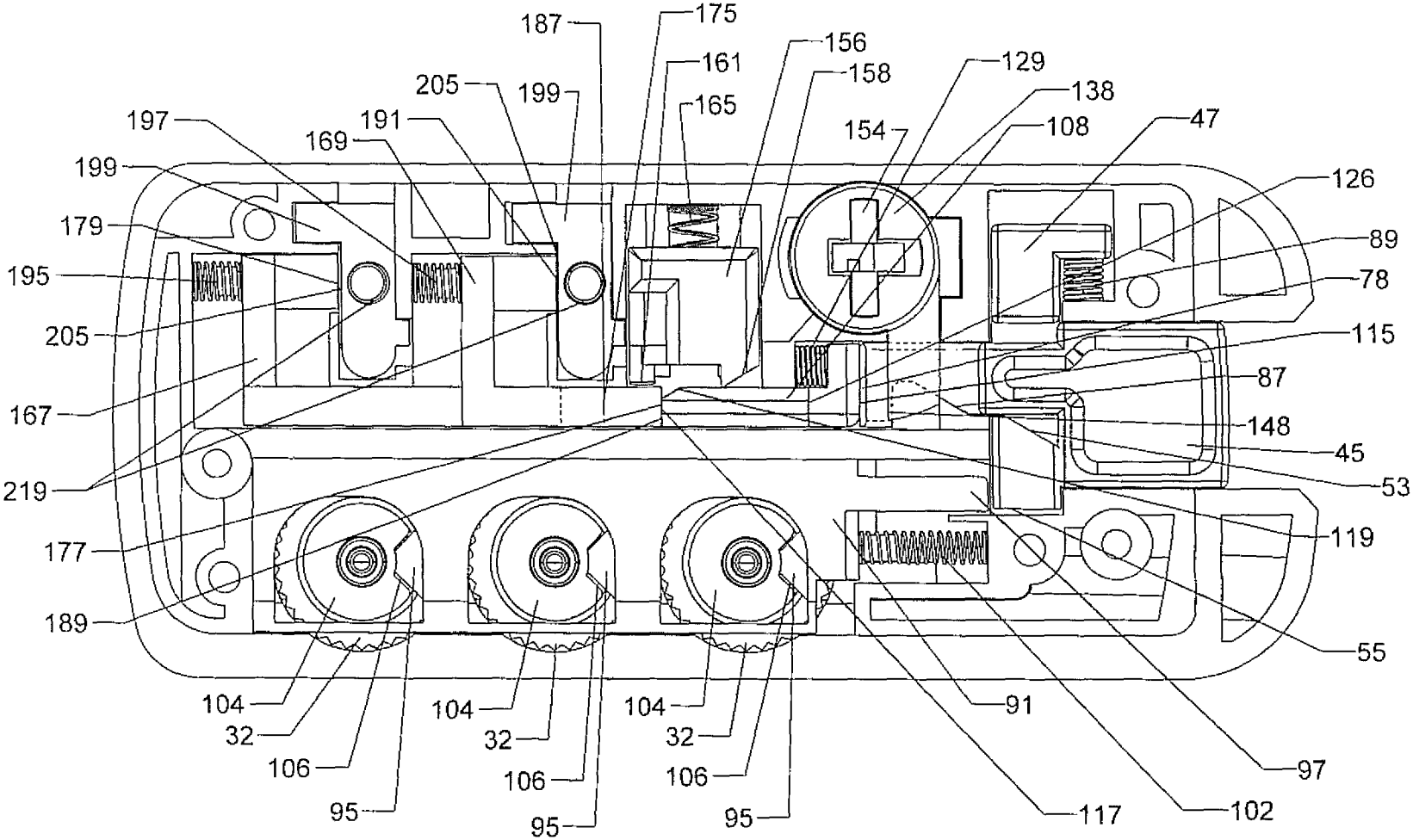
FIG. 4 is a bottom plan view of the exemplary zipper lock with the cover portion of the lock removed, in which the zipper lock is in an unlocked state.
Figure 5:
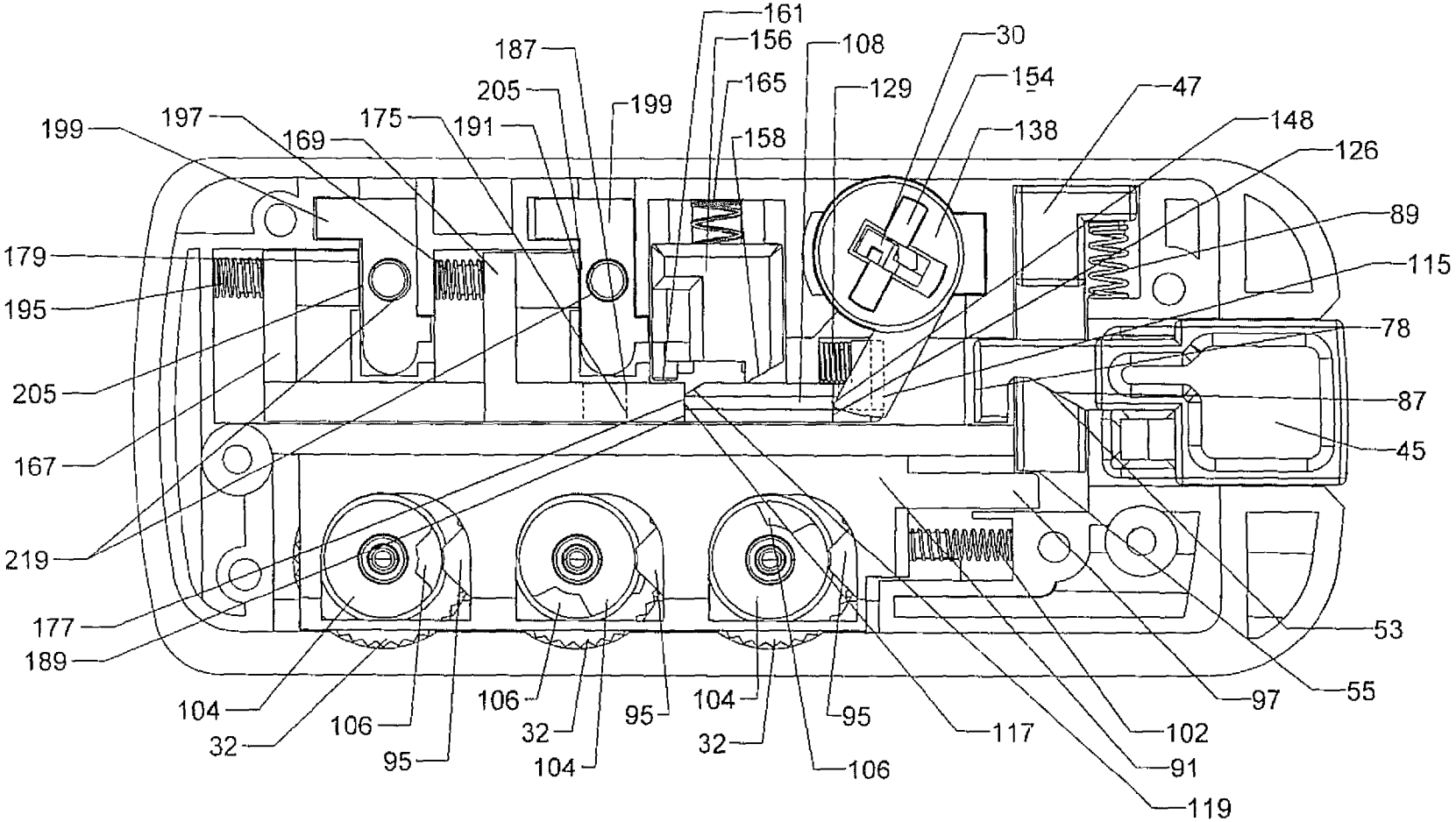
FIG. 5 a bottom plan view of the exemplary zipper lock with the cover portion of the lock removed, in which the zipper lock is in an unlocked state.
Figure 13:
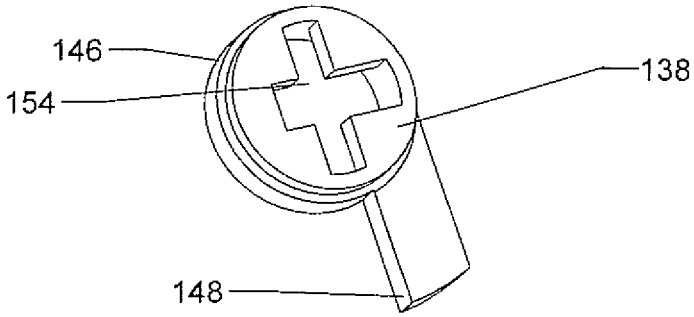
FIG. 13 is a perspective view of an exemplary locking cam of the exemplary zipper lock in accordance with the present invention.

Referring now to FIGS. 3-5, the zipper lock 10 also includes a locking cam 138 positioned for operative engagement with the disc tumbler cylinder 30. As will be discussed further below, it is understood that rotation of the disc tumbler cylinder 30 is configured to cause rotation of the locking cam 138. As shown in detail in FIG. 13, the locking cam 138 is formed from a substantially cylindrical body portion 146 with a locking finger 148 extending therefrom. The locking cam 138 further includes a cross-shaped opening 154 positioned within the substantially cylindrical body portion 146. Referring again to FIGS. 3-5, the locking finger 148 of the locking cam 138 is positioned for engagement with the arm 126 of the latch control plate 108.

Figure 9:
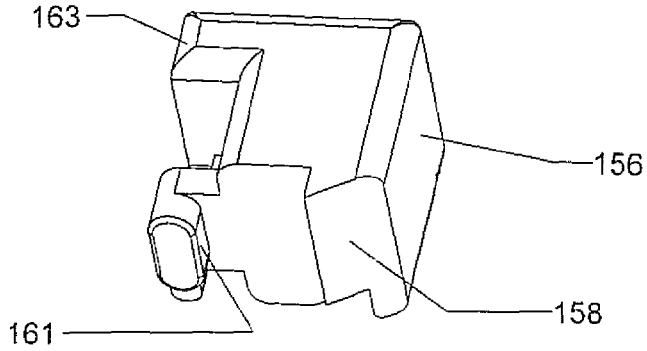
FIG. 9 is a perspective view of an exemplary latch of the exemplary zipper lock in accordance with the present invention.

Referring now to FIGS. 2A-2C and 3-5, the zipper lock 10 further includes a latch 156 positioned for operative engagement with the latch control plate 108. As shown in detail in FIG. 9, the latch 156 includes a slope 158 and a locking finger 161, as well as a shoulder 163 extending from a side of the latch 156. The locking finger 161 may have a substantially cylindrical shape, and may be circular, elliptic or oval in shape, as shown for example in FIG. 9. Referring again to FIGS. 2A-2C and 3-5, the zipper lock 10 includes a latch spring 165 that urges the latch 156 in a direction towards the latch control plate 108 so that the slope 158 of the latch 156 engages with the slope 119 of the latch control plate 108. The zipper lock 10 further includes a left-locking head 167 and a right-locking head 169 configured for locking engagement with the locking finger 161 of the latch 156.

Figure 10A:
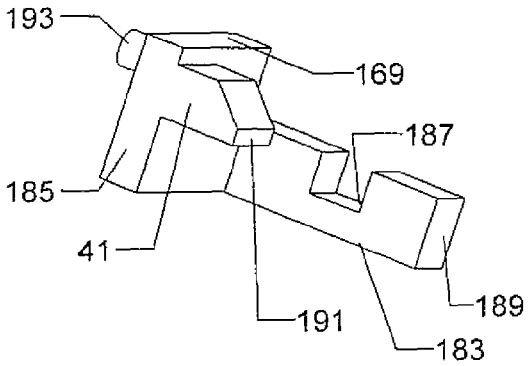
FIG. 10A is a front perspective view of an exemplary right locking head of the exemplary zipper lock in accordance with the present invention.
Figure 10B:
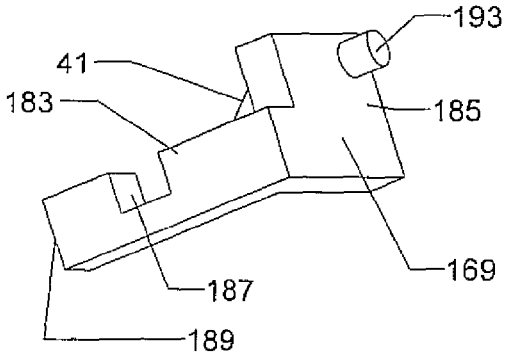
FIG. 10B is a back perspective view of the exemplary right locking head of the exemplary zipper lock in accordance with the present invention.
Figure 11A:
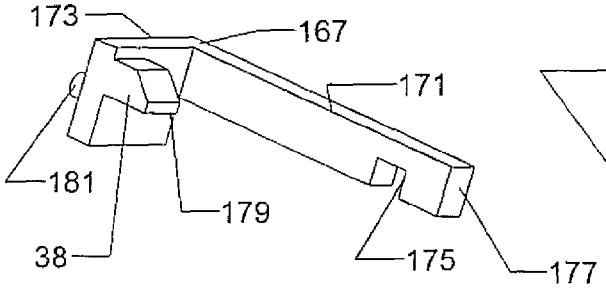
FIG. 11A is a front perspective view of an exemplary left locking head of the exemplary zipper lock in accordance with the present invention.
Figure 11B:
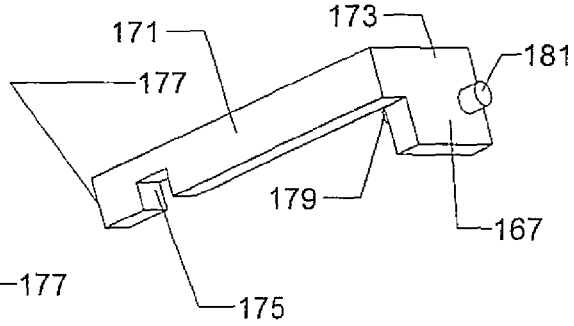
FIG. 11B is a back perspective view of the exemplary left locking head of the exemplary zipper lock in accordance with the present invention.

As shown in detail in FIGS. 11A and 11B, the left-locking head 167 includes a first leg 171 and a second leg 173 extending from an end of the first leg 171. The left-locking head 167 also includes a notch on the first leg 171 that forms a locking area 175 and an end 177 of the first leg 171 that is positioned adjacent to the locking area 175 and opposite the end of the first leg 171 from which the second leg 173 extends from. The left-locking head 167 also includes a plane 179 extending from a surface of the second leg 173, and a cylindrical extension 181 extending from a surface of the second leg 173 opposite the surface from which the plane 179 extends. As shown in detail in FIGS. 10A and 10B, the right-locking head 169 includes a first leg 183 and a second leg 185 extending from an end of the first leg 183. The right-locking head 169 also includes a notch on the first leg 183 that forms a locking area 187 and an end 189 of the first leg 183 that is positioned adjacent to the locking area 187 and opposite the end of the first leg 183 from which the second leg 185 extends from. The right-locking head 169 also includes a plane 191 extending from a surface of the second leg 185, and a cylindrical extension 193 extending from a surface of the second leg 185 opposite the surface from which the plane 191 extends.

Referring again to FIGS. 2A-2C and 3-5, the left-locking head 167 and right-locking head 169 are positioned within the zipper lock 10 so that the locking area 175 of the left-locking head 167 and the locking area 187 of the right-locking head 169 are aligned to form an enclosure configured to retain the locking finger 161 of the latch 156 when the latch 156 is urged in the direction of the first legs 171, 183 of the left-locking head 167 and the right-locking head 169 by the latch spring 165. The cylindrical extension 181 of the left-locking head 167 is configured to engage with a spring 195 that urges the left-locking head 167 in a direction towards the latch control plate 108. The spring 195 urges the left-locking head 167 in this direction so that the locking protrusion 38 can extend through the hole 43 in one of the zipper pull tabs 36 in order to secure the zipper pull tab 36 to the zipper lock 10. The cylindrical extension 193 of the right-locking head 169 is configured to engage with a spring 197 that urges the right-locking head 169 in a direction towards the latch control plate 108. The spring 197 urges the right-locking head 169 in this direction so that the locking protrusion 41 can extend through the hole 43 in one of the zipper pull tabs 36 in order to secure the zipper pull tab 36 to the zipper lock 10.

Figure 12A:
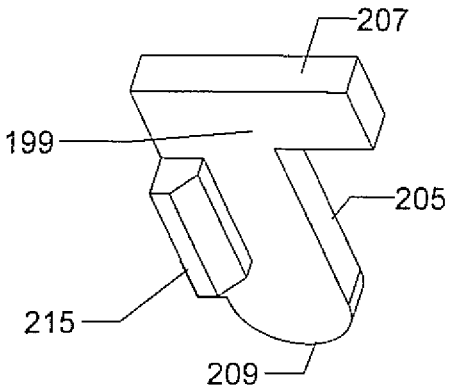
FIG. 12A is a bottom perspective view of an exemplary blocking plate of the exemplary zipper lock in accordance with the present invention.
Figure 12B:
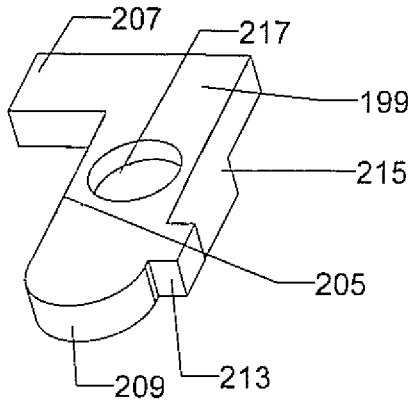
FIG. 12B is a top perspective view of the exemplary blocking plate of the exemplary zipper lock in accordance with the present invention.

Still referring to FIGS. 2A-2C and 3-5, the zipper lock 10 further includes a blocking plate 199 positioned in each cavity 34, and configured to move substantially perpendicular to the movement of the left-locking head 167 and the right-locking head 169. As shown in detail in FIGS. 12A and 12B, the blocking plate 199 includes a wall 205, a shoulder 207 extending from the wall 205 and a rounded end 209 positioned on an opposite side of the blocking plate 199 as the shoulder 207. The blocking plate 199 also includes a tab 213 extending from an opposite side of the blocking plate 199 as the wall 205, and a retaining wall 215 and a spring retaining cup 217.

Referring again to FIGS. 2A-2C and 3-5, the spring retaining cup 217 is configured to receive a blocking plate spring 219 that urges the blocking plate 199 in the direction substantially perpendicular to the movement of the left-locking head 167 and the right-locking head 169 and from the backing plate 22 towards the body 20. The blocking plate spring 219 is configured to move the blocking plate 199 from a first position in which the zipper pull tab 36 is retained within the cavity 34 by either of the locking protrusions 38, 41, to a second position in which the wall 205 of the blocking plate 199 engages with the plane 179 of the left-locking head 167 or the plane 191 of the right-locking head 169 in order to prevent movement of the left-locking head 167 or the right-locking head 169 until the blocking plate 199 is returned to the first position. The first position of the blocking plate 199 can be seen for example in FIGS. 2A-2C and 3, and the second position of the blocking plate 199 can be seen for example in FIGS. 4 and 5.

Referring now to FIGS. 3 and 4, the operation of the combination locking mechanism of the zipper lock 10 will be discussed. FIG. 3 shows the locked configuration of the combination locking mechanism in which the zipper pull tabs 36 are retained in the zipper lock 10. FIG. 4 shows the unlocked configuration of the combination locking mechanism, in which the left-locking head 167 and right-locking head 169 have been moved so as to free the zipper pull tabs 36 from the zipper lock 10. As shown in FIG. 3, when the dials 32 have not been set to display the correct combination of the combination locking mechanism, the notches 106 on the clutches 104 are not aligned so that the protrusions 95 of the locking plate 91 may be received therein. Accordingly, the tail 97 of the locking plate 91 is engaged with the tip 55 of the actuation plate 47 to prevent movement of the actuation plate 47 when a force is applied to the actuator 45. As shown in FIG. 4, when the dials 32 have been set to display the correct combination of the combination locking mechanism, the notches 106 on the clutches 104 are aligned with the protrusions 95 of the locking plate 91 so that the locking plate spring 102 urges the locking plate 91 to move in a direction so that the protrusions 95 are received within the notches 106 of the clutches 104. This movement of the locking plate 91 removes the engagement of the tail 97 of the locking plate 91 from the tip 55 of the actuation plate 47 so that if a force is applied to the actuator 45, e.g. the actuator 45 is pressed towards the body 20 of the zipper lock 10, the slope 87 of the actuator 45 acts upon the slope 53 of the actuation plate 47 so as to urge the actuation plate 47 in a direction substantially perpendicular to the movement of the actuator 45 and opposite the direction that the actuation plate spring 89 urges the actuation plate 47.

Still referring to FIG. 4, the movement of the actuation plate 47 permits the actuator 45 to continue to be moved so that the tip 78 of the actuator 45 comes into contact with the wall 115 of the latch-control plate 108. The force applied to the actuator 45 causes compression of the spring 129 engaged with the latch-control plate 108, and causes the latch-control plate 108 to move in the same direction as the actuator 45. This movement of the latch-control plate 108 causes the slope 119 of the latch-control plate 108 to act upon the slope 158 of the latch 156 in order to move the latch 156 in a direction substantially perpendicular to the movement of the latch-control plate 108, and against the tension of the latch spring 165 acting upon the latch 156. The movement of the latch 156 in this direction releases the locking finger 161 from the locking engagement with the left-locking head 167 and the right-locking head 169 formed by the locking areas 175, 187 of the left-locking head 167 and the right-locking head 169. The removal of the locking finger 161 allows the latch-control plate 108 to be urged further so that the end wall 117 comes into contact with the end 177 of the left-locking head 167 and end 189 of the right-locking head 169. The movement of the latch-control plate 108 is then transferred to the left-locking head 167 and right-locking head 169 so that the locking protrusions 38, 41 can be removed from the holes 43 in the zipper pull tabs 36. Once the zipper pull tabs 36 are removed from the cavities 34, and the locking protrusions 38, 41 are no longer blocking the blocking plates 199, the springs 219 engaged with the blocking plates 199 urge the blocking plates 199 into the second position, as discussed above, so that the walls 205 of the blocking plates 199 engage with the planes 179, 191 of the left-locking head 167 and right locking head 169 to prevent the left-locking head 167 and right-locking head 169 from being urged by the springs 195, 197 so that the locking protrusions 38, 41 do not extend into the cavities 34 until the zipper pull tabs 36 are reinserted into the cavities 34. When the zipper pull tabs 36 are reinserted into the cavities 34, the zipper pull tabs 36 urge the blocking plates 199 against the force applied on the blocking plates 199 by the springs 219 so that the walls 205 of the blocking plates 199 move away from engagement with the planes 179, 191 of the left-locking head 167 and right-locking head 169. In this manner, the locking protrusions 38, 41 can extend through the holes 43 of the zipper pull tabs 36 so that the zipper pull tabs 36 are secured within the cavities 34 of the zipper lock 10 by the locking protrusions 38, 41 and retaining walls 215 of the blocking plates 199. Once the incorrect combination for the combination locking mechanism has been set on the dials 32, and a force is no longer applied to the actuator 45 the zipper lock 10 will be in the locked state as shown in FIG. 3, for example, and the zipper pull tabs 36 will be secured to the zipper lock 10.

The combination of the combination locking mechanism can be reset or reconfigured in the following manner. When the dials 32 are aligned to the correct combination for the combination locking mechanism, the notches 106 of the clutches 104 will be aligned with the protrusions 95 of the locking plate 91, as shown for example in FIG. 4. This alignment allows the locking plate 91 to move as discussed above since the locking plate spring 102 is acting upon the locking plate 91. As the locking plate 91 moves, the tail 97 of the locking plate 91 moves in the same direction as the locking plate 91. Once the tail 97 of the locking plate 91 moves, a user of the zipper lock 10 can push the actuator 45 towards the body 20 of the zipper lock 10. As the actuator 45 is pushed, the actuation plate 47 will also move as discussed above. As the actuation plate 47 moves, the tip 55 will block the tail 97 of the locking plate 91, and the locking plate 91 cannot move when the tip 55 is in this position. Since the notches 106 are engaged with the protrusions 95, the locking plate 91 is not able to move, and therefore, the user can push and hold the actuator 45 and turn the dials 32 in order to set another combination for the combination locking mechanism.

Referring now to FIGS. 3 and 5, the operation of the key locking mechanism of the zipper lock 10 will be discussed. FIG. 3 shows the locked configuration of the key locking mechanism in which the zipper pull tabs 36 are retained in the zipper lock 10. FIG. 5 shows the unlocked configuration of the key locking mechanism, in which the left-locking head 167 and right-locking head 169 have been moved so as to free the zipper pull tabs 36 from the zipper lock 10. As shown in FIG. 5, when a correct key (not shown) is inserted into the disc tumbler cylinder 30 of the key locking mechanism, the disc tumbler cylinder 30 is permitted to turn so that the rotation of the disc tumbler cylinder 30 is transferred to the locking cam 138 engaged with the disc tumbler cylinder 30. The rotation of the locking cam 138 moves the locking finger 148 to engage with the arm 126 of the latch-control plate 108, and urge the latch-control plate 108 against the force applied upon the latch-control plate 108 by the spring 129. This movement of the latch-control plate 108 causes the slope 119 of the latch-control plate 108 to act upon the slope 158 of the latch 156 in order to move the latch 156 in a direction substantially perpendicular to the movement of the latch-control plate 108, and against the tension of the latch spring 165 acting upon the latch 156. The movement of the latch 156 in this direction releases the locking finger 161 from the locking engagement with the left-locking head 167 and the right-locking head 169 formed by the locking areas 175, 187 of the left-locking head 167 and the right-locking head 169. The removal of the locking finger 161 allows the latch-control plate 108 to be urged further so that the end wall 117 comes into contact with the end 177 of the left-locking head 167 and end 189 of the right-locking head 169. The movement of the latch-control plate 108 is then transferred to the left-locking head 167 and right-locking head 169 so that the locking protrusions 38, 41 can be removed from the holes 43 in the zipper pull tabs 36. Once the zipper pull tabs 36 are removed from the cavities 34, and the locking protrusions 38, 41 are no longer blocking the blocking plates 199, the springs 219 engaged with the blocking plates 199 urge the blocking plates 199 into the second position, as discussed above, so that the walls 205 of the blocking plates 199 engage with the planes 179, 191 of the left-locking head 167 and right locking head 169 to prevent the left-locking head 167 and right-locking head 169 from being urged by the springs 195, 197 so that the locking protrusions 38, 41 do not extend into the cavities 34 until the zipper pull tabs 36 are reinserted into the cavities 34. When the zipper pull tabs 36 are reinserted into the cavities 34, the zipper pull tabs 36 urge the blocking plates 199 against the force applied on the blocking plates 199 by the springs 219 so that the walls 205 of the blocking plates 199 move away from engagement with the planes 179, 191 of the left-locking head 167 and right-locking head 169. In this manner, the locking protrusions 38, 41 can extend through the holes 43 of the zipper pull tabs 36 so that the zipper pull tabs 36 are secured within the cavities 34 of the zipper lock 10 by the locking protrusions 38, 41 and retaining walls 215 of the blocking plates 199. Once the incorrect combination for the combination locking mechanism has been set on the dials 32, and a force is no longer applied to the actuator 45 the zipper lock 10 will be in the locked state as shown in FIG. 3, for example, and the zipper pull tabs 36 will be secured to the zipper lock 10.

It is understood that the zipper lock 10, and the components thereof, may be made from any suitable material, for example metals, metal alloys and/or sufficient durable plastics.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense.

It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A lock, comprising:

a latch movable between a first position and a second position;

a first locking mechanism operatively coupled to the latch;

a second locking mechanism operatively coupled to the latch; and at least one locking head operatively coupled to the first locking mechanism and the second locking mechanism, wherein the at least one locking head is positionable between a closed position and an open position and configured for positioning in the open position when the latch is in the second position;

a control plate operatively coupled to the latch and configured for movement in a direction substantially perpendicular to the movement of the latch; and at least one blocking plate operatively coupled to each of the at least one locking head; wherein the at least one blocking plate is movable in a direction substantially perpendicular to the movement of the at least one locking head between a retained position and an ejected position;

wherein the first locking mechanism and the second locking mechanism are each configured to independently cause the movement of the control plate in the direction substantially perpendicular to the movement of the latch, and wherein such movement of the control plate is configured to move the latch into the second position and to move the at least one locking head into the open position; and wherein wherein the at least one locking head comprises a locking area formed within the at least one locking head and positioned to surround at least a portion of the latch when the latch is in the first position so as to maintain the at least one locking head in the closed position.

2. The lock according to claim 1, wherein the latch comprises a substantially cylindrical extension;

wherein the substantially cylindrical extension comprises the portion of the latch surrounded by the locking area of the at least one locking head; and wherein the lock further comprises a latch spring operatively coupled to the latch and configured to urge the latch into the first position, and a locking head spring for each locking head of the at least one locking head configured to urge the at least one locking head into the closed position.

3. The lock according to claim 2, wherein the first locking mechanism comprises a lock cylinder, a locking cam operatively coupled to the lock cylinder, and a finger extending from the locking cam and operatively coupled to the control plate.

4. The lock according to claim 3, wherein the first locking mechanism is operative between a locked position and an unlocked position;

wherein when the first locking mechanism is in the locked position the finger is spaced away from the control plate, and when the first locking mechanism is in the unlocked position the finger is configured for positioning in operative engagement with the control plate; and wherein when the first locking mechanism is in the unlocked position the latch is movable to the second position and the at least one locking head is positionable in the open position.

5. The lock according to claim 4, wherein in the unlocked position of the first locking mechanism the finger is configured to operatively engage with the control plate to cause rectilinear movement of the control plate towards the latch; and wherein the rectilinear movement of the control plate is configured to move the latch in a direction substantially perpendicular to the rectilinear movement of the control plate in order to move the latch into the second position and thereby disengage the cylindrical extension of the latch from the locking area of the at least one locking head.

6. The lock according to claim 5, wherein in the unlocked position of the first locking mechanism the finger is further configured to operatively engage with the control plate to cause further rectilinear movement of the control plate towards the at least one locking head;

wherein the further rectilinear movement of the control plate is configured to move the at least one locking head into the open position.

7. The lock according to claim 4, wherein the first locking mechanism is configured for operation between the locked position and the unlocked position through the use of a tool.

8. The lock according to claim 7, wherein the tool comprises a key.

9. The lock according to claim 3, wherein the control plate is configured to transfer angular movement of the finger to rectilinear movement of the at least one locking head in order to move the at least one locking head into the open position.

10. The lock according to claim 2, wherein the second locking mechanism comprises an actuator operatively coupled to the control plate, a locking plate operatively coupled to the actuator, and at least one rotatable clutch configured to restrict movement of the locking plate.

11. The lock according to claim 10, wherein the locking plate is movable between a locked position and an unlocked position; and wherein the second locking mechanism further comprises a locking plate spring configured to urge the locking plate into the unlocked position.

12. The lock according to claim 11, wherein the locking plate comprises at least one opening formed therein, and each opening of the at least one opening comprises a protrusion extending into the opening;

wherein each opening of the at least one opening has one of the at least one rotatable clutch positioned therein;

wherein each rotatable clutch of the at least one rotatable clutch comprises a notch formed therein and configured to receive the protrusion;

wherein when the notch and the protrusion are substantially aligned the locking plate spring is configured to urge the locking plate into the unlocked position; and wherein when the notch and the protrusion are not substantially aligned the at least one rotatable clutch is configured hold the locking plate in the locked position.

13. The lock according to claim 12, wherein the second locking mechanism further comprises an actuation plate operatively coupled to the actuator and movable between a blocking position and an actuated position, and an actuation plate spring configured to urge the actuation plate into the blocking position;

wherein the locking plate further comprises a tail extending therefrom and configured to operatively engage with the actuation plate when the locking plate is in the locked position and have a spaced apart relationship with the actuation plate when the locking plate is in the unlocked position; and wherein the tail is configured to substantially retain the actuation plate in the blocking position when the tail is operatively engaged with the actuation plate.

14. The lock according to claim 13, wherein in the unlocked position of the locking plate the actuator is configured to move the actuation plate into the actuated position and to operatively engage with the control plate to cause rectilinear movement of the control plate towards the latch; and wherein the rectilinear movement of the control plate is configured to move the latch in a direction substantially perpendicular to the rectilinear movement of the control plate in order to move the latch into the second position and thereby disengage the cylindrical extension of the latch from the locking area of the at least one locking head.

15. The lock according to claim 14, wherein in the unlocked position of the locking plate the actuator is further configured to operatively engage with the control plate to cause further rectilinear movement of the control plate towards the at least one locking head;

wherein the further rectilinear movement of the control plate is configured to move the at least one locking head into the open position.

16. The lock according to claim 10, wherein each of the at least one rotatable clutch is operatively connected to a dial comprising a substantially circular surface having indicia thereon.

17. The lock according to claim 10, wherein the actuator comprises a button.

18. The lock according to claim 1, wherein the lock further comprises a blocking plate spring for each of the at least one blocking plate configured to urge the at least one blocking plate into the ejected position.

19. The lock according to claim 1, wherein the at least one blocking plate comprises a wall formed on an edge of the at least one blocking plate; wherein the wall is configured to hold the at least one locking head in the open position when the at least one blocking plate is in the ejected position.

20. The lock according to claim 1, wherein the lock is configured to securely retain at least one zipper pull tab of a zipper, wherein the at least one zipper pull tab comprises an opening formed therein;

wherein the at least one locking head comprises a locking protrusion extending therefrom, and dimensioned for insertion into the opening of the at least one zipper pull tab;

wherein the at least one blocking plate comprises a retaining wall extending therefrom, and positioned on the at least one blocking plate for operative engagement with the locking protrusion when the at least one locking head is in the closed position in order to securely retain the at least one zipper pull tab to the lock.

* * * * *